United States Patent [19]

Borenstein

[11] Patent Number: 4,642,893

[45] Date of Patent: Feb. 17, 1987

[54] SHAVING COOLER

[75] Inventor: Charles Borenstein, North Miami Beach, Fla.

[73] Assignee: Cryo-Genics, Inc., Miami, Fla.

[21] Appl. No.: 710,419

[22] Filed: Mar. 11, 1985

[51] Int. Cl.[4] ..... B76B 21/40; B26D 5/64

[52] U.S. Cl. ..... 30/90; 30/41; 222/162; 222/192

[58] Field of Search ..... 30/41, 86, 90; 401/190; 222/162, 192

[56] References Cited

U.S. PATENT DOCUMENTS 3,342,544 9/1967 Curiel ..... 222/162 X 3,364,068 1/1968 Stern ..... 30/41 X

*Primary Examiner*—Douglas D. Watts

*Attorney, Agent, or Firm*—Eugene F. Malin

[57] ABSTRACT

A method and apparatus for improving the performance of razors. Immediately before use, the razor's edge is cooled to cause the metal of the razor to contract thermally, causing microscopic irregularities on the blade edge to recede, resulting in a sharper, smoother, blade, which is capable of giving a superior shave. In the preferred embodiment of an apparatus to cool such a razor, a coolant is sprayed on the razor's edge immediately before shaving.

11 Claims, 8 Drawing Figures

SHAVING COOLER

BACKGROUND OF THE INVENTION

Microscopic irregularities on the shaving edges of razors cause these razors to perform very poorly when shaving. Because of thermal expansion, these irregularities, and hence this poor performance, is exacerbaded by heating razors immediately before shaving.

SUMMARY OF THE INVENTION

Accordingly, it is an object of this invention to provide an improved method for shaving by providing a method and apparatus for cooling a cutting edge of a razor immediately before use so as to cause the metallic part of the razor to thermally contract, thus increasing the edge's sharpness and evening out its microscopic irregularities.

In accordance with these and other objects which shall become apparent hereinafter, there is disclosed a method and apparatus for improving the performance of a razor by cooling the razor's cutting edge immediately before use. In preferred embodiments of the invention, there is provided an apparatus that sprays fluid coolant on the razor's edge. The razor is provided with a box-like receptacle, an outer portion of which is adapted to supportingly receive the razor, and an inner portion which contains a cannister of fluid coolant. The razor's edge is disposed in an opening in the receptacle immediately adjacent the discharge nozzle of the cannister. The receptacle has a push button, operation of which causes the cannister's nozzle to discharge cooling fluid directly upon the razor's edge. The cannister itself has the fluid under pressure, and the nozzle may advantageously have a fluid exit port in the form of a venturi. As fluid exits the nozzle, it expands, cools as it expands, and finally impinges upon the edge of the razor. The result is a razor that lasts longer and shaves much more smoothly and closely. An additional benefit is that the cold razor also cools one's skin during shaving, thus desensitizing the skin and providing an even more comfortable shave.

The instant invention will be more fully understood from the following detailed description, it being understood, however, that the invention is capable of extended application and is not confined to the precise disclosure. Changes and modifications may be made that do not affect the spirit of the invention, nor exceed the scope thereof, as expressed in the appended claims. Accordingly, the invention will now be described with reference to the accompanying drawings, wherein:

DETAILED DESCRIPTION OF THE INVENTION

Figure 1:
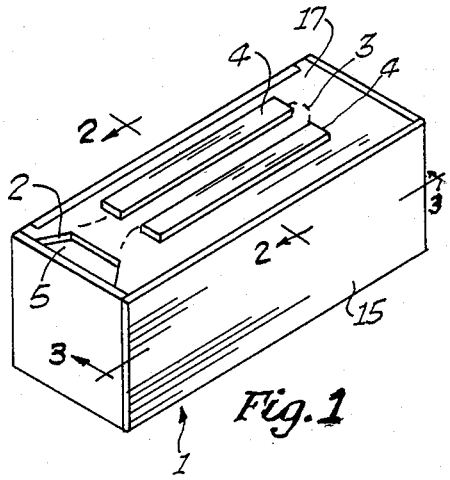
FIG. 1 is an elevational isometric view of the preferred embodiment of the invention in a prone position.

With reference to the drawing figures, and in particular FIG. 1, there is seen a preferred embodiment 1 of the apparatus of the instant invention. Apparatus 1 has a razor comprising cutting portion 2 and handle portion 3 disposed on a receptacle having a plurality of sides, including sides 14, 15, 17. Side or panel 17 has a pair of elongate ridges 4 between which rests handle portion 3 of the razor. Panel 17 contains an opening 5 in which is located cutting portion 2. The apparatus of FIG. 1 is shown as it would appear in use, that is, reclining lengthwise in the horizontal with razor portions 2, 3, and ridges 4, disposed horizontally.

Figure 5:
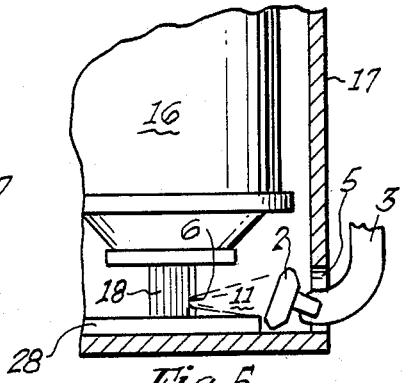
FIG. 5 is a partial view similar to that of FIG. 3, in cross section.

With particular reference to FIGS. 2 through 5, the receptacle contains a cannister 16, disposed lengthwise in the receptacle. Cannister 16 rests horizontally within the receptacle between a pair of protuberances 26, which serve to prevent cannister 16 from rolling back and forth within the receptacle. Cannister 16 is generally cylindrical, and elongate. One end of cannister 16 contains a spring-loaded aerosol nozzle 18, depression of which causes the contents of cannister 16 to be expelled. The contents can be a volatile fluid under pressure, for example Freon. Nozzle 18 has an exit orifice 6, which can preferably be in the form of a venturi constriction so as to cause the contents of cannister 16 to expand upon expulsion, thereby cooling the expelled Freon to a temperature far below ambient. Rigidly joined to nozzle 18, for example by gluing, is registration member 28. Member 28 is planar, with a vertical shape complementary to the interior of the receptacle so as to fix cannister 16 against rotation about its elongate axis, thus maintaining nozzle 18 and orifice 6 aimed directly at hole 5 and razor portion 2. At the elongate end of cannister 16 distal from nozzle 18 there is a generally flat base portion 7 disposed immediately adjacent a broad and flat plate 8. Plate 8 is a portion of a push-button structure additionally comprising stem 9, spring 32 and finger operated push-button 10. Depression of 10 against the resistance of spring 32 causes stem 9 and plate 8 to force cannister 16 to move along its elongate length and press nozzle 18 downwardly, thus opening spring loaded nozzle 18 and causing the expulsion of a portion of the contents of cannister 16. As best seen in FIG. 5, this expelled fluid 11 impinges directly upon cutting portion 2 of the razor containing the razor's sharpened edge or edges. The relatively cool fluid 11 immediately cools the razor edges in portion 2, rendering these edges sharper and less irregular and enabling the razor to give a far superior shave.

Figure 8:
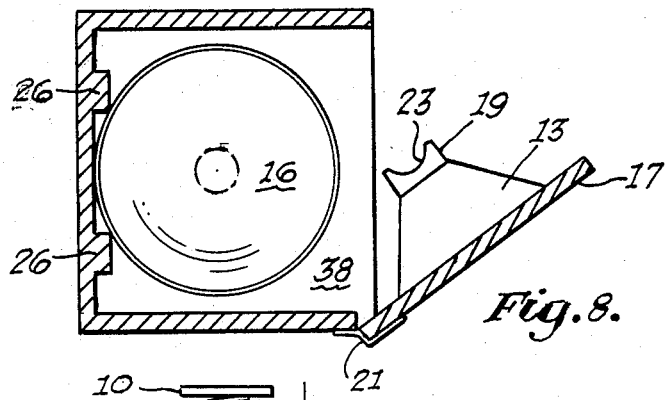
FIG. 8 is a partial transverse cross section of FIG. 6 with a portion open.
Figure 3:
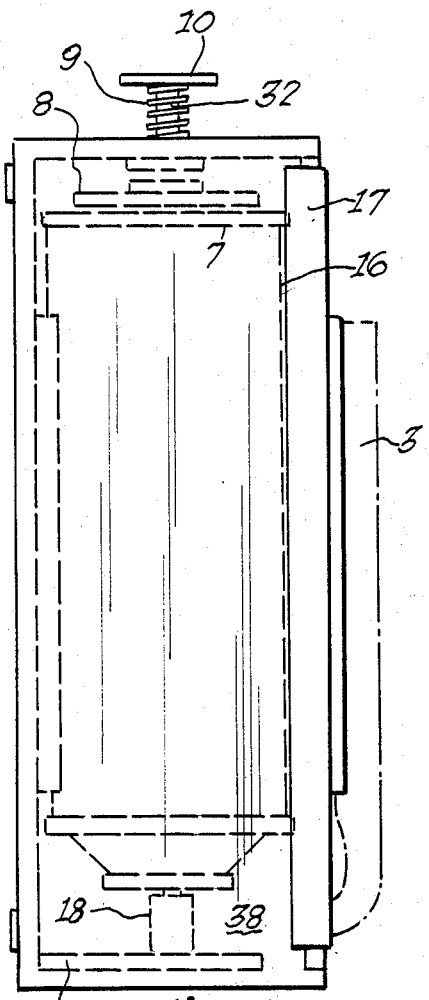
FIG. 3 is a side elevational view of FIG. 1 in an upright position.
Figure 4:
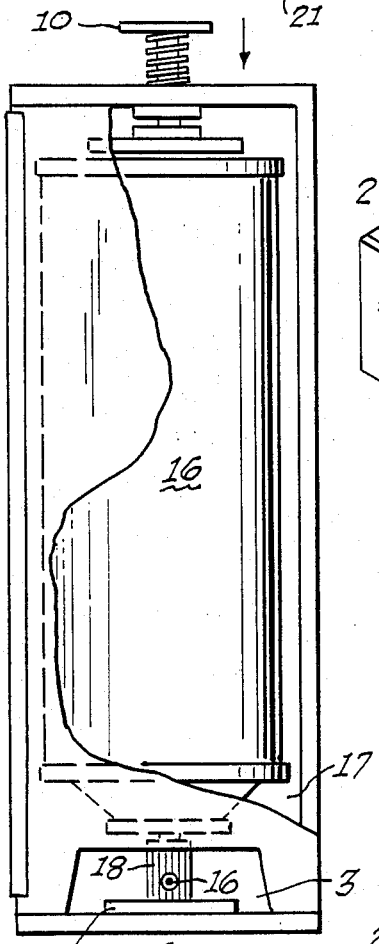
FIG. 4 is a front elevational view with the invention being cut away so as to expose a portion of the interior of the device illustrated.
Figure 6:
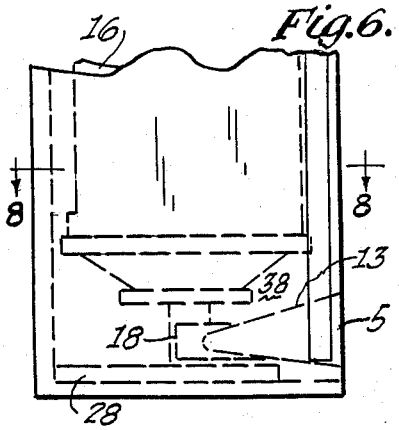
FIG. 6 is a partial side view similar to that of FIG. 3 of an alternative preferred embodiment.
Figure 7:
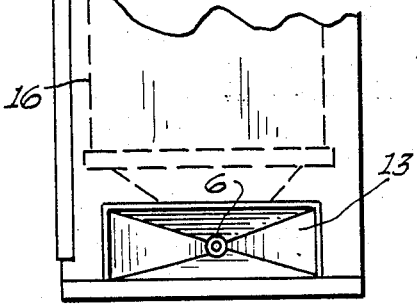
FIG. 7 is a partial front view similar to that of FIG. 4 of the alternative preferred embodiment.
Figure 2:
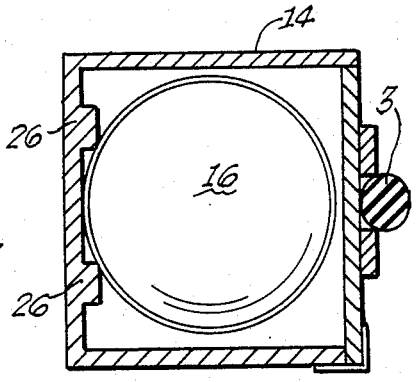
FIG. 2 is a sectional view taken along the lines 2—2 and looking in the direction of the arrows in FIG. 1.

In FIGS. 6 to 8 an alternative embodiment is illustrated. Funnel 13 (best seen in FIG. 7, shown by dotted lines in FIG. 6) connects orifice 6 and hole 5, thereby more efficiently directing expelled fluid 11 onto the razor's cutting portion 2 disposed in hole 5. Panel 17 can be hinged as at 21 so as to allow easy access to the interior of the receptacle and to cannister 16. Funnel 13 is fixedly attached to panel 17 so that if 17 is rotated about 21, funnel 13 rotates with 17 to completely clear access to cannister 16. Funnel 13 can have a termination 19 with a contoured surface 23 to snuggly fit against nozzle 18 to ensure that fluid 11 exiting from orifice 6 is conducted into funnel 13, rather than into inner compartment 38 of the receptacle.

Although illustrated as horizontally disposed, cannister 16 and its receptacle could as easily be vertically disposed, with appropriate provision made for securing razor 2, 3 against falling from the receptacle.

The foregoing description is organized along the lines of several embodiments. This division is for purposes of illustration, rather than limitation, and in particular is not done to imply that particular elements of one embodiment could not be used, or should not be used advantageously with those of another embodiment. More generally, the foregoing description has illustrated the invention in what is considered to be the most practical and preferred manner. It is recognized, however, that departures may be made therefrom within the scope of the invention, and that obvious modifications may occur to a person skilled in the art. Accordingly, the scope of the instant invention is to be discerned by reference to the appended claims, wherein:

What I claim is:

1. An apparatus for improving the performance of a razor, said razor having at least one metallic, sharpened edge, and a handle, comprising:

receptacle means for receiving and supporting said razor, said receptacle means having an internal compartment and at least one external wall, said external wall having securing means for receiving and removably supporting said razor handle, said external wall having an opening for receiving the head of said razor;

cannister means for containing a fluid under pressure, said cannister means including means for spraying said fluid in a controlled direction, said cannister means moveably secured within said internal compartment of said receptacle means, said receptacle means including means for disposing said spraying means such that said spraying means is aligned with said receptacle means wall opening;

said means for spraying being a valve having a venturi flow orifice causing said fluid to expand and cool when exiting said cannister;

said receptacle means including means for activating said cannister spraying means;

whereby a razor can be secured to said receptacle means, said cannister spraying means can be activated, causing said fluid to substantially cool the head of said razor, thereby increasing the sharpness and reducing the irregularities of said razor's edge.

2. The apparatus of claim 1 wherein said cannister means comprises a cylindrical cannister and said receptacle means comprises a generally rectangular, box shaped receptacle.

3. The apparatus of claim 1, wherein:

said cannister is elongate and disposed along an elongate length, said canniser having two distal ends, one of said distal ends being a flat based portion, the other of said distal ends being said means for spraying, said means for spraying being a spring-loaded aerosol spray nozzle;

said receptacle is a generally rectangular box having a hole in the vicinity of said spray nozzle, said cannister being disposed within said box along said elongate length of said cannister;

said box comprising a spring loaded button means for moving said cannister within said box along said elongate length, said button means comprising a generally flat plate portion disposed within said box and adjacent said base portion, an elongate stem portion joined to said plate portion and extending through said box along said elongate length, and a push-button portion joined to said stem outside said box;

said means for disposing comprising a registration plate joined to said spray nozzle, said registration plate being shaped to cooperate with the interior shape of said box to locate said orifice of said spray nozzle directly opposite said hole;

said razor is a safety razor comprising an elongate handle portion and an elongate cutting portion, said elongate cutting portion being disposed generally perpendicular to said handle portion, said cutting portion comprising said edge;

said box comprising a pair of ridges disposed on the outside of said box and extending along said elongate length, said hole and said ridges being disposed so that said razor is supportingly received by said box by said cutting portion being located within said hole and said handle being located between said pair of ridges, said hole and said ridges being further disposed so that if said razor is received by said box said edge is adjacent of and facing said orifice of said aerosol spray nozzle;

said apparatus being further adapted so that the pressing of said push-button portion is effective to cause said plate portion to push said cannister along said elongate length to force said spring-loaded aerosol spray nozzle against a portion of said box in a manner effective to cause said spray nozzle to release and direct a portion of said fluid to said edge disposed in said edge.

4. The apparatus of claim 3, wherein said apparatus comprises a funnel means for directing said fluid from said nozzle to said hole.

5. The apparatus of claim 4, wherein said fluid is Freon.

6. The apparatus of claim 1, wherein said fluid is Freon.

7. The apparatus of claim 3, wherein said apparatus comprises a funnel means for directing said fluid exiting said cannister to said edge.

8. The apparatus of claim 7, wherein said box comprises a door means for opening or closing access to the interior of said box, said door means comprising a door panel and a hinge swingingly connecting said door means to said box, said door comprising said hole, said funnel being fixedly joined to said door for movement with said door.

9. The apparatus of claim 3, wherein said box comprises a door means for opening or closing access to the interior of said box, said door means comprising a door panel and a hinge swingingly connecting said door means to said box,

10. A method for improving the performance of a razor, said razor including a cutting edge having microscopic nicks, cracks, and other irregularities, said method comprising:

placing a cannister within a receptacle, said cannister containing a fluid under pressure;

said cannister including means for spraying said fluid in a controlled direction, said means for spraying being a valve having a venturi flow orifice causing said fluid to expand and cool when exiting said cannister; said cannister being removeably secured within said receptacle;

removeably securing said razor to the external surface of said receptacle, said receptacle having an opening, said razor head positioned through said opening;

positioning said cannister means for spraying in the direction of said razor head;

activating said cannister means for spraying, thereby releasing said cooling fluid in the direction of said razor head;

whereby said razor head becomes substantially cooled effecting a contraction and sharpening of said razor's cutting edge allowing for an efficient and comfortable shave.

11. The method of claim 10 wherein said razor has more than one cutting edge.

* * * * *